United States Patent [19]

Timoshenko et al.

[11] Patent Number: 4,457,331

[45] Date of Patent: Jul. 3, 1984

[54] PULSE HYDRAULIC MONITOR

[76] Inventors: Grigory M. Timoshenko, bulvar Pushkina, 27, kv. 33; Vladimir G. Kranets, ulitsa Vareikisa, 36; Vladimir G. Timoshenko, bulvar Pushkina, 27, kv. 33; Petr F. Zima, prospekt Ilicha, 7, kv. 44; Alexandr Z. Astrakhan, bulvar Pushkina, 29, kv. 13; Valentin M. Overko, ulitsa Universitelskaya, 109, kv. 32; Vasily S. Isadchenko, bulvar Shkolny, 4, kv. 104; Stanislav A. Lenenko, ulitsa Krasnoflotskaya, 76, kv. 12; Gennady G. Goldynsky, ulitsa Gertsena, 71-a, kv. 27, all of Donetsk; Karo A. Osmanian, bulvar Kronshtatsky, 24, Korpus, kv. 37, Moscow; Evgeny G. Aralov, oblast, Dobropolie, ulitsa Nizovaya, 31, Donetskaya; Georgy V. Maleev, prospekt Teatralny, 24, kv. 4, Donetsk; Igor A. Kuzmich, ulitsa Donskaya, 3, kv. 25; Boris Y. Ekber, ulitsa Zoologicheskara, 3, kv. 73, both of Moscow; Nikolai A. Kreschenko, Oblast, Novodonetsk, ulitsa Moskovskays, 6/3, Donetskaya, all of U.S.S.R.

[21] Appl. No.: 381,302

[22] Filed: May 24, 1982

[51] Int. Cl.[3] ..... F01L 25/04

[52] U.S. Cl. ..... 137/119; 137/624.14

[58] Field of Search ..... 137/119, 624.14; 91/516; 92/62

[56] References Cited

U.S. PATENT DOCUMENTS

| | | | |
|---|---|---|---|
| 3,614,965 | 10/1971 | Metivier | 137/119 |
| 3,971,398 | 7/1976 | Taylor et al. | 137/624.14 |
| 4,056,123 | 11/1977 | Kimura et al. | 137/624.14 |

FOREIGN PATENT DOCUMENTS 800354 4/1979 U.S.S.R. .

*Primary Examiner*—Martin P. Schwadron
*Assistant Examiner*—James R. Shay
*Attorney, Agent, or Firm*—Lilling & Greenspan

[57] ABSTRACT

A pulse hydraulic monitor comprises two barrels for alternately directing a pulsating jet of liquid onto a target, a valve means for dividing the flow of liquid, having an inlet for a hydraulic liquid, and two outlets for delivering the same into the barrels, and pulse-forming means. The pulse-forming means includes a through hollow enclosure, a separating member, two limit stops of the separating member, means for retarding the motion of the separating member. The through hollow enclosure is in hydraulical relationship with the barrels and the separating member is movable between two end positions relative the barrels so as to take one of these two end positions for forming a pulse when the pressure of the hydraulic liquid flowing in the corresponding barrel assumes a predetermined value. The means for retarding the motion of the separating member is made in the form of a pipe filled with the hydraulic liquid under the pressure produced by a pressure source, or of a cylindrical compression spring, or of a sleeve closed by a membrane and filled with a compressed gas. The separating member operates as a result of the liquid pressure assuming a predetermined value in the corresponding barrel only after the pressure in said barrel is incresed to a desired value.

13 Claims, 11 Drawing Figures

PULSE HYDRAULIC MONITOR

BACKGROUND OF THE INVENTION

1. Field of the Invention

The present invention relates to apparatus for forming pulsating jets of a liquid, and in particular of water, and which are known as pulse hydraulic monitors. The invention may be used for hydraulic breaking in mining, in hydraulic engineering, and power engineering.

2. Description of the Prior Art

There is known a pulse hydraulic monitor (USSR Author's Certificate No. 800,354) comprising at least two barrels for directing a pulsating jet, a valve means for dividing a flow of liquid, having an inlet for a hydraulic liquid supplied from a pressure source and at least two outlets for delivering the hydraulic liquid into the corresponding barrels, and a pulse-forming means. The pulse-forming means includes a through hollow enclosure hydraulically connected with the barrels, a separating element disposed within the same enclosure and movable between two end positions relative said barrels to assume one of these two positions wherein a pulse is formed at a moment when the pressure of the hydraulic liquid flowing in the corresponding barrel as a result of changing-over of said valve means for dividing the flow of liquid, assumes a predetermined value, and at least two limit stops to stop the travel of the separating member at its end position for forming a pulse, each limit stop functionally associated with the corresponding barrel.

The prior art hydraulic monitor works on the conversion of the stationary flow of liquid into a pulsating one and subsequently accelerating the liquid with the aid of the pulse-forming means and retarding it before the nozzle, due to which a high-pressure impulse is superimposed onto the pulsating flow.

The hydraulic liquid pressure in the barrels of the prior art apparatus does not exceed that of the supplied liquid and remains constant for the whole pulse duration. Hence, throughout the pulse period the duration of which is about 0.1 second, the liquid discharge from each barrel is uniform. The liquid pressure during the pulse period can be raised by increasing the amplitude of its pulse.

However, in the prior art apparatus the amplitude of the elevated pressure pulse cannot be raised, since the changing-over of the pulse-forming means, in response to which the flow-dividing valve diverts the liquid flow to the other barrel, takes place before the liquid pressure in the barrel reaches the desired value.

In this case the efficiency of breaking a burden or any other target can be raised by increasing the pressure in the pressure source, which is not expedient, for such increase in the pressure of the pressure source would cause additional consumption of energy and raise the price of production equipment.

SUMMARY OF THE INVENTION

The primary object of the present invention consists in the provision of a pulse hydraulic monitor wherein the operation of the pulse-forming means takes place at the moment when the pressure in the barrel of the hydraulic monitor assumes a desired value.

Another object of the invention is to provide a pulse hydraulic monitor wherein the operation of the pulse-forming means is delayed, said delay being effected before the pressure in one of the barrels assumes a desired value.

Still another object of the invention is to provide a hydraulic monitor wherein a high pressure amplitude in the pulse is maintained within the desired range.

A further object of the invention is to provide a hydraulic monitor providing a higher efficiency in mineral winning or rock breaking, and also improving hydraulic transportation of broken burden.

These and other objects of the invention are attained in a pulse-hydraulic monitor, wherein the pulse forming means is provided with means for retarding the motion of the separating member, arranged within the enclosure of the pulse-forming means so that said means is subjected to a constant force applied from one side and interacts with the separating member on the other side in response to the action of the constant force applied from the first side and an increasing force produced as a result of the increase in the pressure of the hydraulic liquid flowing in the corresponding barrel, from the other side.

Such construction of the proposed hydraulic monitor provides a high pressure amplitude in a desired range throughout the pulse duration, which improves the efficiency in hydraulic breaking, for instance, a coal block. In addition, such construction is relatively simple, and hence more reliable.

The invention may be variously embodied. For example, the means for retarding the motion of the separating member may be made in the form of a compression spring, or of an elastic element using the energy of compressed gas, or of a duct through which a hydraulic liquid is passed under a predetermined pressure. The pulse-forming means may have various modifications depending on the construction of the means for retarding the motion of the separating member, which modifications will be disclosed in the detailed description of the invention given below.

The invention will now be explained with reference to embodiments thereof represented in the accompanying drawings.

DETAILED DESCRIPTION OF THE INVENTION

Figure 1:
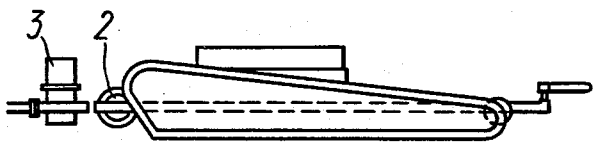
FIG. 1 is a general view of a pulse hydraulic monitor of the invention.

A pulse hydraulic monitor (FIGS. 1, 2 and 3) comprises a power-driven mounting 1 on which are mounted valve means 2 for dividing the flow of liquid, a hydropneumatic accumulator 3, pipe-lines 4 and 5, and pulse-forming means 6 and 7 provided with means for retarding the motion of a separating member in the form of pipe-lines 8 and 9. The liquid flow dividing valve means 2 comprises a body 10 having seats 11 and 12, an inter-seat space 13 communicating through the inner cavities of the hydropneumatic accumulator 3 with a delivery pipe-line 14, and within the cavities 15 and 16 located behind the seats are disposed pistons 18 and 19 rigidly connected to one another through a rod 17. Further, the cavities 15 and 16 are connected with barrels 20 and 21 provided with nozzles of the same diameter through the pipe-lines 4 and 5, and hinges 22 and 23. Piston ends 24 and 25 communicate with the pipe-lines 4 and 5 and hence with the barrels 20 and 21 through by-pass pipes 26 and 27 having a hydraulic resistance higher than that of the nozzles. The piston ends 24 and 25 are separated from the cavities 28 and 29 with an elastic element (compressed gas) by separating membranes 30 and 31 whose travel is limited from both sides by gratings 32 and 33 and 34 and 35 respectively. One of the piston ends, for instance the piston end 25, communicates with the atmosphere through a control valve 36. Mounted on the pipe-lines 4 and 5 close to the barrels 20 and 21 having nozzles of the same diameter are pulse-forming means 6 and 7 having separating members in the form of at least two piston-and-rod assemblies including pistons 37 and 38 and rods 39 and 40 respectively, which piston-and-rod assemblies are disposed within enclosure members 41 and 42 which are divided by partition walls 43 and 44 into two chambers 45 and 46 and 47 and 48 respectively. The chambers 45 and 46 communicate through the pipe-lines 9 and 8 with the supply pipe-line 14, and the chambers 47 and 48 communicate through ports 49 and 50 with the pipe-lines 5 and 4. The piston areas of the pistons 37 and 38 having rods 39 and 40 respectively are selected so as to provide in the pipe-lines, while they travel to initial position, a pressure, for instance, of about 2.0 MPa.

In addition, in the piston end of each enclosure member 41 and 42 and adjacent the corresponding barrel are mounted limit stops 43*a* and 44*a* for limiting the travel of the pistons 37 and 38 respectively, in the direction of the corresponding barrel 21 and 20.

The proposed apparatus operates in the following manner. When the control valve 36 is open, and the pistons 18 and 19 with the rods 17 are in the end right position, the hydraulic liquid from the delivery pipe-line 14, passing through the inner space of the hydropneumatic accumulator 3, fills the inter-seat space 13 of the enclosure 10 of the flow-dividing valve 2, passes through the gap between the piston 19 and the seat 11, then into the cavity 15 and wherefrom into the pipe-line 5, hinges 23, and the barrel 21 with a nozzle, and then through said nozzle into the atmosphere. At the same time the hydraulic liquid passing from the pipe-line 5 through the by-pass pipe 27 fills the piston end 25 of the piston 19, but since the control valve 36 is open the pressure in this piston end is near the atmospheric pressure. The pressure in the piston end 24 is also near the atmospheric pressure as this cavity through the by-pass pipe 26 and the barrel 20 also communicates with the atmosphere. As a result, the separating membranes 30 and 31 of the cavities 28 and 29 with elastic elements are urged by the gas pressure against the gratings 32 and 33. The piston 37 with the rod 39 of the pulse-forming means 7 is in its right end position at the partition wall 43 of the enclosure member 41, the chamber 47 filled with the liquid from the pipe-line 5. The piston 38 with the rod 40 of the pulse-forming means 6, under the action of the pressure of the liquid supplied from the delivery pipe-line 14 through the pipe-line 8 to the chamber 46, is also in the right end position close to the port 50 of the pipe-line 4, the chamber 47 being not filled with the liquid.

An autooscillation mode of operation of the proposed apparatus is started by closing the control valve 36. In this case the liquid pressure in the piston end 25 of the piston 19 is smoothly increasing until the separating membrane 31, being forced by the liquid pressure from the grating 33, reaches the grating 35, whereafter said pressure in the piston end 25 instantaneously increases to the supplied pressure, that is to a pressure which is equal to the pressure in the pipe-line 5. As a result, a force is produced which causes the pistons 18 and 19 with the rod 17 to move from the right end position to the left end position, in which case the hydraulic liquid is caused to flow from the inter-seat space 13 of the flow-dividing valve means 2 not to the barrel 21 through the pipe-line 5 but to the barrel 20 through the pipe-line 4. The main flow of the hydraulic liquid passing through the gap between the piston 18 and the seat 12 flows into the cavity 16 behind the seat 12, the pipe-line 4, the hinge 22, the barrel 20, and then outflows through the nozzle into the atmosphere. At the same time the liquid from the pipe-line 4 passes through the port 50 into the chamber 48 to fill it and move the piston 38 with the rod 40 from the right end position from the port 50 up to the stop at the partition wall 44 of the pulse-forming means 6. While the piston 38 with the rod 40 is moving from its right end position to its left end position, the liquid is forced from the chamber 46 through the pipe-line 8 into the supply pipe-line 14. In this case the hydraulic resistance of the system is determined by the hydraulic resistance of the nozzle of the barrel 20 and the port 50 until the piston 38 with the rod 40 abuts the partition wall 44 of the enclosure member 42. The period of time which is necessary for the liquid to fill the chamber 48 of the pulse-forming means 6 depends on the volume thereof, the hydraulic resistance of the port 50, and also on the initial pressure in the pipe-line 4, which pressure is equal to the pressure difference sufficient to cause the piston 38 with the rod 40 to travel from one end position to the other one.

A transition process taking place in the system during operation is characterized by propagation of the pressure shock waves between the pulse-forming means 6 and the hydropneumatic accumulator 3 and by the acceleration of the liquid in the left flow passage part of the pulse hydraulic monitor. The increase in the liquid flow speed will take place as long as the piston 38 with the rod 40 is moving in the chambers 48 and 46. As soon as the piston 38 with the rod 40 reaches the left end position, i.e. stops at the partition 44 of the enclosure member 42, the motion of the hydraulic liquid which has been accelerated in the right flow passage part of the monitor is now decelerated before the nozzle of the barrel 20 so as to produce a hydraulic impact. The pressure in the pipe-line 4 and the barrel 20 sharply increases. A high pressure wave propagates from the nozzle of the barrel 20 along the pipe-line 4 to the cavity 16 behind the seat, the gap between the seat 12 and the piston 18, and the inter-seat space 13 to the hydropneumatic accumulator 3 mounted on the supply pipe-line 14, which high-pressure wave reflects from the hydropneumatic accumulator 3 in the form of a pressure wave, wherein the pressure is near the pressure in the pipe-line 14. While the impact wave is travelling to the hydropneumatic accumulator and back, the liquid pressure in the piston end 24 of the piston 18, which piston end is filled with the liquid through the pipe 26 from the pipe-line 4, is firstly smoothly increasing until the separating membrane 30, being forced by the liquid pressure from the grating 32, reaches the grating 34 whereafter the increase in its pressure proceeds sharply to reach the value of the pressure in the pipe-line 4. At the same time the fluid from the piston end 25 through the by-pass pipe 27 into the pipe-line 5. In this case the pressure in the piston end 25 is first maintained equal to the pressure in the pipe-line 5 when the piston 37 with the rod 39 is caused by the pressure to move from the side of the chamber 45, connected with the supply pipe-line 14 through the pipe-line 9, and from the partition wall 43 of the enclosure member 41 to the port 49 and then, as a result of outflowing of the liquid from the pipe-line 5, through the nozzle of the barrel 21 into the atmosphere, smoothly decreases until the separating membrane 31, being forced from the grating 35, reaches the grating 33. At this moment the process in the pipe-line 5 is attenuated and the pressure therein becomes equal to the atmospheric pressure. The pressure in the cavity 25 also decreases to atmospheric pressure, but in a step-wise manner. The pressure before the nozzle of the barrel 20 first rapidly increases to surpass the pressure in the supply pipe-line and the gradually assumes the value of the latter. When the pressures are redistributed, the pistons 18 and 19 with the rod 17 in the piston ends begin to move from the left end position to the right end position.

As the process repeats, the system starts operating in the autooscillation mode.

Operation in the autooscillation mode is ceased by opening the control valve 36, in which case the pressure in the piston end 25 is maintained near atmospheric pressure and the pistons 18 and 19 with the rod 17 of the flow-dividing valve means 2 are in the right end position.

Thus, the construction of the means for retarding the motion of the separating member, in the form of pipes, simplifies the construction of a pulse hydraulic monitor and improves the reliability thereof. This provides an equal amplitude of high pressure in a pulse in autooscillation mode of operation. Thus, if the volume of the enclosure of the pulse-forming means is 2 liters, the diameter of the pipe-lines is 60 mm and the length thereof is 5 m, and the pressure of the supplied liquid is 10 MPa, there can can be produced an amplitude of an elevated pressure of 25 MPa at a frequency of 5 Hz. Furthermore, the outflow of the liquid from the pipe-lines through the nozzle of the barrels into the atmosphere, while the piston-and-rod assemblies are moving back to their initial position, can proceed under the pressure of 2.0 MPa. This is achieved by selecting appropriate relations between the piston and the rod, for instance 1:5. That is, the area of the rod is 5 times less than that of the piston, which relation together with the pressure of the supplied liquid of 10 MPa produces in the pipe-lines a pressure which is 5 times less, i.e. 2.0 MPa. Under such pressure the liquid flows from the nozzle of the barrels at a rate of 36 cu m per hr, which is used to improve the hydraulic transportation of broken burden.

Figure 4:
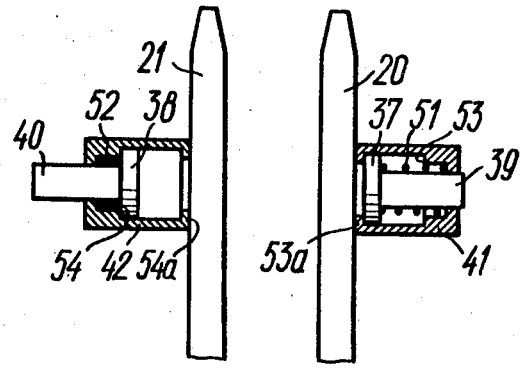
FIG. 4 illustrates one embodiment of the invention, wherein the pulse-forming means is shown in section.

In one embodiment of the invention the means for retarding the motion of the separating member (FIG. 4) is composed of two compression springs 51, 52 mounted within the enclosure member of the pulse-forming means 6. The enclosure is made in the form of two cylinders 41 and 42 having central openings, each cylinder being mounted on the corresponding barrel 20 or 21. The separating member is made in the form of two rods 39 and 40, each being provided with a piston 37 or 38 respectively and mounted in the corresponding cylinder 41 or 42. The piston end of each cylinder 41 and 42 is hydraulically connected with the corresponding barrel 20 or 21, and within the rod end of the cylinder there is provided a limit stop for terminating the motion of the piston at its end position for forming a pulse, made in the form of a shoulder 53 and 54 on the inner surface of the cylinder.

Each compression spring 51 and 52 is fitted on the corresponding rod 39 or 40 so that one end of said spring abuts against the piston and the other end thereof abuts against the rod end portion of the cylinder.

Further, in each cylinder 41 and 42, adjacent the barrels are provided limit stops **53*a* and 54*a* for limiting the travel of the pistons 37 and 38** in the direction of the corresponding barrel.

Figure 5:
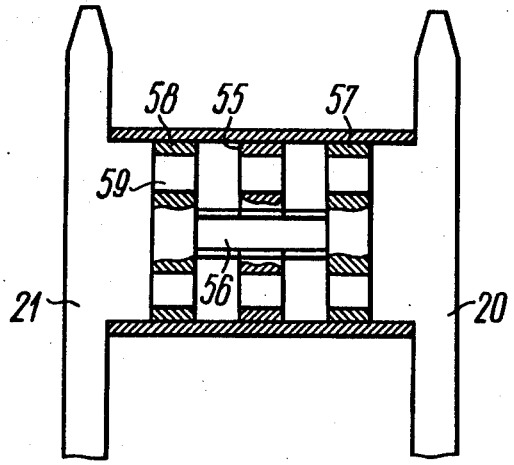
FIG. 5 is an axial sectional view of the pulse-forming means made according to another modification of the invention.

In another embodiment of the invention (FIG. 5) the limit stop is made in the form of a stationary partition wall 55, having a central opening through which the rod 56 of the separating member is extending. The separating member is composed of two cylinders 57 and 58 disposed in spaced relationship on opposite sides from the partition wall 55 and rigidly fitted on the rod 56 over the whole length of which between the pistons 57 and 58 is provided an external thread, and in the partition wall 55 is cut a through internal thread.

The thread on the rod 56 and the mating thread in the central opening of the partition wall 5 serve to slow down the speed of motion of the separating member.

A port 59 is provided in both pistons 57 and 58 of the separating member and in the partition wall 55, which port 59 has a sectional area in such relation to the full sectional area of each piston 57 and 58 or the partition wall 55 that a force acting on the piston and varying depending on the variation in the pressure of the hydraulic liquid in the corresponding barrel 20 or 21, exceeds the frictional force in the threaded portions of the rod 56 and the partition wall 55 so as to cause the piston to move at a predetermined speed to the position for forming a pulse.

The threaded connection between the rod 56 and the partition wall 55 is selected to provide rotation of the pistons 57 and 58 and their ports 59 relative the ports in the partition wall 55 so that the liquid flow is cut off by the piston and the partition wall 55.

Figure 6:
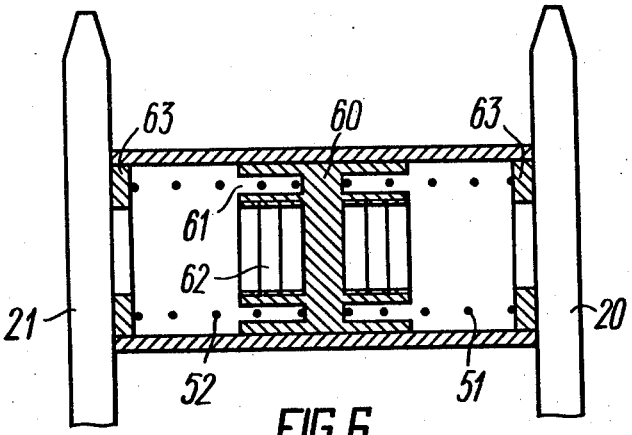
FIG. 6 is an axial sectional view of the pulse-forming means made according to still another modification of the invention.

According to still another embodiment of the invention (FIG. 6) the separating member is made in the form of a piston 60 having on each its butt-end an annular blind groove 61, and a blind central threaded hole into which is screwed a disc 62 for varying the depth of the threaded hole, and thus varying the cavity of the pulse-forming means from the side of the corresponding barrel 20 or 21.

Mounted within the enclosure member of the pulse-forming means are two stops for limiting the travel of the piston 60, each stop being made in the form of a ring 63 or a disc having a central opening for the water to pass into the enclosure of the pulse-forming means, and which is rigidly secured adjacent the corresponding barrel 20 or 21.

In the enclosure member of the pulse-forming means there is also provided a means for retarding the motion of the piston 60, made in the form of two cylindrical compression springs 51 and 52, each having one end fitted in the blind annular groove 61 and its other end pushing against the ring 63 or the disc having a central opening.

Figure 7:
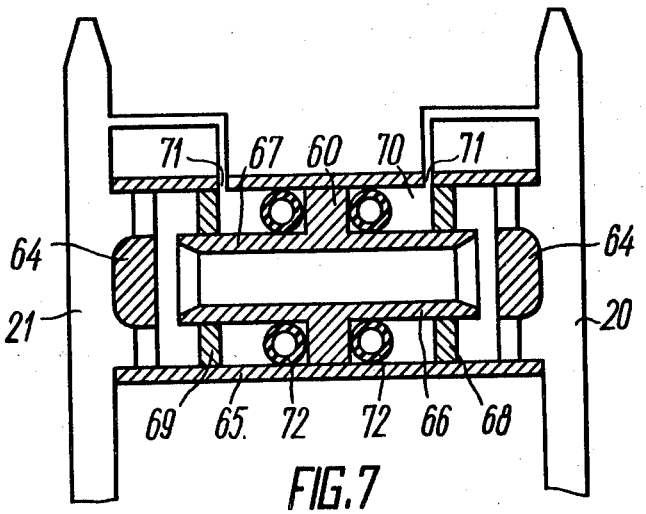
FIG. 7 is an axial sectional view of another modification of the proposed apparatus.

According to yet another embodiment of the invention represented in FIG. 7, the pulse-forming means includes two means for slowing down the speed of motion of the separating member, each said device being made in the form of a fairing 64 arranged within the enclosure member 65, adjacent the corresponding barrel 20 or 21.

The separating member is made in the form of a piston 60 with two rods 66 and 67 provided with a through axial duct for hydraulically communicating the barrels 20 and 21 with one another, and bearing end faces for alternately providing a fluid-tight contact with the corresponding deflector 64 when the piston 60 is travelling between two end positions.

Within the enclosure member of the pulse-forming means on opposite sides from the piston 60 there are arranged partition walls 68 and 69 provided with central openings through which openings the corresponding rods 66 or 67 of the piston 60 are extending in a fluid-tight relationship.

Each partition wall 68 and 69 forms together with the piston 60 an annular chamber 70 communicating through the opening 71 in the enclosure 65 of the pulse-forming means with the corresponding barrel 20 or 21.

The means for retarding the motion of the separating member is composed of two annular tubes 72 made for instance from a rubber pipe, filled with a gas, for instance, nitrogen, and each said tube 72 is placed into the corresponding chamber 70 about the corresponding rod 66 or 67 of the piston 60 between the piston and the partition walls 68 and 69.

Figure 8:
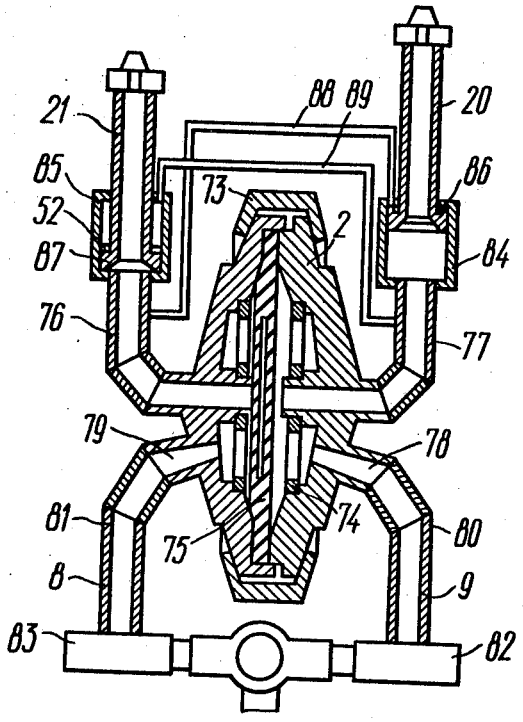
FIG. 8 is a sectional of another modification of the proposed apparatus.

According to a further embodiment of the invention, the flow-dividing valve means 2 incorporated in a hydraulic monitor (see FIG. 8) is made in the form of two shaped flanges connected from the outside with the aid of a quick-to-remove lock 73. Each flange has a stepped annular chamber wherein is arranged a grating 74. Mounted between the end faces of the flanges is a membrane 75.

Each said flange has a central opening through which the chambers formed by said flanges communicate with the supply pipe-lines 76 and 77. In this case the membrane 75 is mounted so as to close one of the central openings.

The chambers of the flanges are further provided with conical openings 78 and 79 through which said chambers communicate with the pipe-lines 80 and 81 respectively and also with the hinges 82 and 83 respectively.

On the ends of the supply pipe-lines 76 and 77 are mounted cylindrical enclosure members 84 and 85 of the pulse-forming means. In each said enclosure 84 and 85 is mounted a hollow rod 20 or 21 having an extension on one end and an annular separating member 86 and 87. The return spring 51 and 52 is mounted on the rod in the enclosure member of each pulse-forming means.

In addition, each enclosure member 84 and 85 of the pulse-forming means on the side of the separating member 86 and 87 communicates with the delivery pipe-line 76 or 77 from the flow-dividing valve means 2, and on the side of the rod 20 or 21 is hydraulically connected through pipes 88 or 89 with the delivery pipe-lines 76 or 77 of the other enclosure members 84 or 85 of the pulse-forming means.

Figure 9:
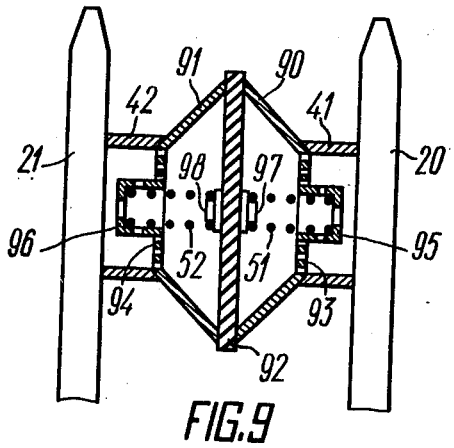
FIG. 9 is a sectional view of an embodiment of the invention, wherein the means for retarding the motion of the separating member is made in the form of a spring.

A modification is also possible (see FIG. 9), wherein the means for retarding the motion of the separating member of the pulse-forming means is a cylindrical compression spring 51 or 52 disposed between the separating member and the limit stop for terminating the motion of said separating member at its end position for forming a pulse.

In this case the enclosure member of the pulse-forming means is composed of two cylinders 41 and 42, each provided with a bell-mouth 90 or 91, respectively, facing each other. Gripped between the bell-mouths 90 and 91 is a membrane 92 serving as a separating member. On opposite sides from the membrane 92 in the cylindrical portion of the enclosure member close to each barrel 20 and 21 are mounted limit stops of the membrane 92, made in the form of gratings 93 and 94, each said grating having in its central portion a seat 95 whose bottom portion protrudes in the direction of the corresponding barrel 20 or 21 so as to prevent one of the ends of the spring 51 or 52 from radial displacement.

Figure 10:
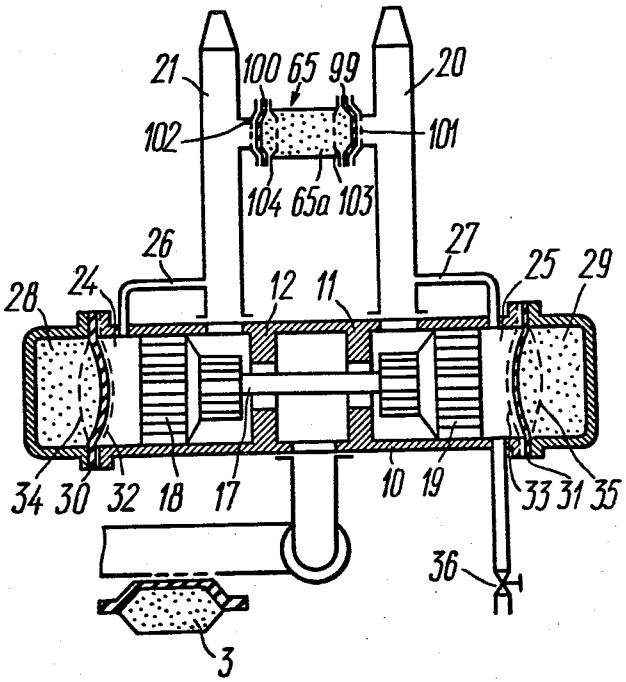
FIG. 10 is a sectional view of an embodiment of the invention, wherein the means for retarding the motion of the separating member is made in the form of an elastic element movable under the action of a compressed gas.

A modification is also possible (FIG. 10), wherein the means for retarding the motion of the separating member includes a portion **65*a* of the enclosure member 65 of the pulse-forming means, wherein close to the corresponding barrel 20 or 21 are arranged limit gratings. The separating member is made in the form of two membranes 99 and 100 each being located close to the limit gratings 101 and 102, and together with the portion 65*a* of the enclosure member 65 of the pulse-forming means form a chamber filled with a compressed gas, for instance, nitrogen. The limit stops of the membranes 99 and 100 for terminating the motion thereof at their end position for forming a pulse are made in the form of two gratings 103 and 104 each being disposed within the chamber close to each membrane 99 or 100**.

Each limit grating 101 or 102 and the limit stop are so disposed relative the membrane 99 or 100 that they provide a predetermined travel of each membrane between two end positions.

Figure 11:
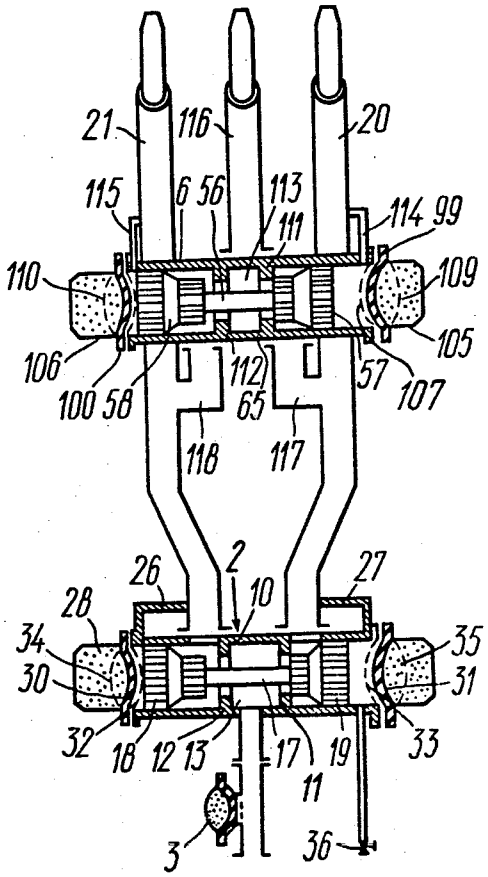
FIG. 11 is a sectional view of an embodiment of the invention, wherein the means for retarding the motion of the separating member is made substantially as that in FIG. 10.

The means for retarding the motion of the separating member (FIG. 11) may include two chambers 105 and 106 made each in the form of a sleeve closed by the membrane confined by the external grating 107 or 108 and the internal grating 109 or 110.

Each sleeve is filled with a compressed gas, for instance, nitrogen, due to which the membranes 99 and 100 are normally urged against the external gratings 107 and 108.

The sleeves are mounted coaxially on the butt-ends of the enclosure member 65 of the pulse-forming means so that the membranes 99 and 100 face inwardly of this enclosure 65.

The limit stop for terminating the motion of the separating member at its end position for forming a pulse includes two partition walls 111 and 112 arranged in the middle portion of the enclosure 65 of the pulse-forming means with a space provided between them so that they together with the enclosure member 65 form a central chamber 113 and in the wall portion of the enclosure member, defining said central chamber, there is provided an outlet opening (not shown).

Each partition wall 111 and 112 has a central opening.

The separating member is made in the form of two pistons 57 and 58 disposed externally of the partition walls 111 and 112, and connected with each other by the rod 56 extending with a gap through the openings in the partition walls 111 and 112.

The cavity of the enclosure member 65 of the pulse-forming means close to each butt-end of said enclosure member 65 is hydraulically connected with the corresponding barrels 20 and 21 through corresponding by-pass ducts 114 and 115.

According to another modification of the proposed apparatus (FIG. 11) on the enclosure member 65 of the pulse-forming means is mounted a third barrel 116 communicating with the central chamber 113 of the enclosure member 65 of the pulse-forming means through the outlet opening.

In this case the cavity of the enclosure member 65 of the pulse-forming means, disposed close to and externally of the partition walls 111 and 112, is hydraulically connected with the corresponding barrel 20 or 21 through the pipe-lines 117 and 118.

Figure 3:
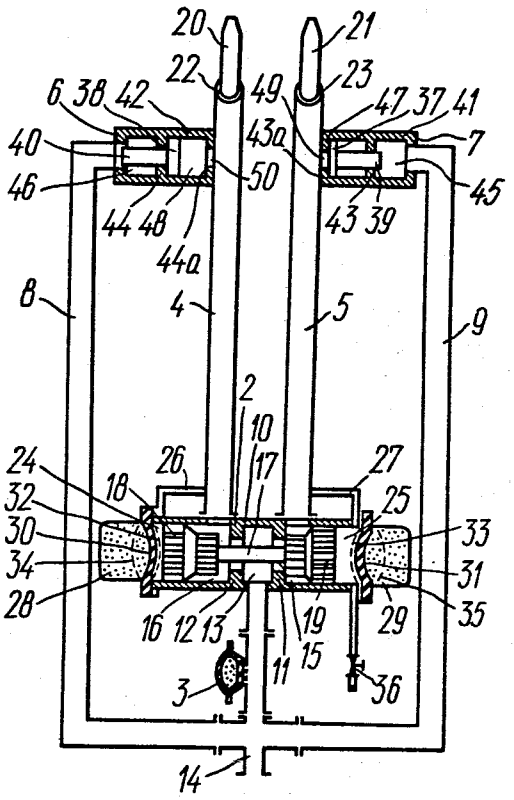
FIG. 3 schematically represents the proposed hydraulic monitor, wherein main assemblies are shown in section.
Figure 2:
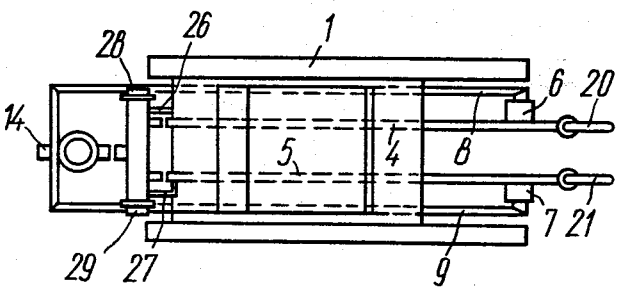
FIG. 2 is a top view of the hydraulic monitor in FIG. 1.

As may be seen from the above description and as shown in FIGS. 4, 6, 8 and 9, the means for retarding the motion of the separating member, for instance, a piston or a membrane, is made in the form of a compression spring which works like the water under pressure which is substantially equal to the pressure produced by the pressure source in the pipe-lines 8 and 9 (FIGS. 2 and 3). It will be clear to those skilled in the art that in the other embodiments of the invention, wherein the means for retarding the motion of the separating member is made in the form of a thread (FIG. 5), an elastic tube filled with a compressed gas (FIG. 7), or an elastic assembly in the form of a sleeve closed by a membrane and filled with a compressed gas (FIGS. 10 and 11), the proposed apparatus operates in a similar manner as an apparatus of the invention shown in FIGS. 1–3. Furthermore, each modification of the pulse-forming means partially depends on the construction of the means for retarding the motion of the separating member, although other modifications may be made in the invention without departing from the spirit and scope of the appended claims.

We claim

1. A pulse hydraulic monitor comprising:

at least two barrels for alternately directing a pulsating jet of hydraulic liquid onto a target;

valve means for dividing the flow of said hydraulic liquid, having an inlet for said hydraulic liquid supplied from a pressure source, and at least two outlets for delivering said hydraulic liquid into the corresponding barrels;

pulse-forming means including a through hollow enclosure member in hydraulical relationship with said barrels, a separating member disposed within said enclosure member and movable between two end positions relative to said barrels so as to assume one of said end positions for forming a pulse at a moment when the pressure of the hydraulic liquid flowing in the corresponding barrel as a result of changing-over of said valve means assumes a predetermined value, and at least two limit stops for terminating the motion of said separating member at its end position for forming a pulse, each limit stop being functionally associated with the corresponding barrel;

means for retarding the motion of said separating member, arranged in the cavity of said enclosure member of said pulse-forming means so that it is subjected to a constant force applied from one side and interacts with said separating member on the other side in response to the action of the constant force applied from said one side and an increasing force produced as a result of an increase in the hydraulic liquid pressure in the corresponding barrel, from the other side.

2. A hydraulic monitor according to claim 1, wherein the means for retarding the motion of the separating member is made in the form of a pipe having its one end connected with the pressure source and filled with the hydraulic liquid under pressure which is substantially equal to the pressure produced by the pressure source, the enclosure member of the pulse-forming means is composed of at least two through cylinders, each cylinder being mounted on the corresponding barrel, the separating member includes at least two pistons with a rod, each piston being disposed in the corresponding cylinder, and the piston end of each cylinder is hydraulically connected with the corresponding barrel and accomodates a piston stop adapted for restraining the motion of the piston in the direction of the barrel and adjacent the same barrel, the rod end of the cylinder is hydraulically connected with the other end of the pipe, and the limit stop for terminating the motion of the separating member at its end positions for forming a pulse is made in the form of a partition wall disposed in the rod end of the cylinder and having an opening through which said rod is extending in fluid-tight relationship whose end face takes up a pressure of the hydraulic liquid in the pipe.

3. A hydraulic monitor according to claim 1, wherein the means for retarding the motion of the separating member is made in the form of a cylindrical compression spring, the enclosure member of the pulse-forming means is made from at least two through cylinders, each cylinder being mounted on the corresponding barrel, the separating member is made in the form of at least two piston-and-rod assemblies, each being disposed in the corresponding cylinder, the head end of each cylinder being hydraulically connected with the corresponding barrel and having a piston stop provided therein to restrain the motion of the piston in the direction of the barrel and located close thereto, and the limit stop for terminating the motion of the separating member at its end postion for forming a pulse is made in the form of a shoulder provided on the inner surface of the cylinder in the rod end thereof, and the compression spring is put on the rod so that its one end butts against the piston and the other end butts against rod end portion of the cylinder.

4. A hydraulic monitor according to claim 1, wherein the limit stop for terminating the motion of the separating member at its end position for forming a pulse is made in the form of a partition wall arranged within the enclosure member of the pulse-forming means and having a central opening, the separating member is composed of at least two pistons disposed in spaced relationship on opposite sides of the partition wall and fitted on the rod extending through said central opening in said partition wall, and the means for retarding the motion of the separating member includes a thread on the rod, extending from one piston to the other one, and a mating thread on the portion of the partition wall, defining said central opening, which mating thread being in engagement with said thread on the rod so that the rod can move in axial direction, thereby moving the pistons between two end positions.

5. A hydraulic monitor according to claim 4, wherein the partition wall and each piston has a port having a cross-sectional area which is in such a relation to a full cross-sectional area of each piston or of the partition wall that the increasing force acting on the piston as a result of an increase in the hydraulic liquid pressure in the corresponding barrel exceeds the frictional force in the threaded portions of the rod and the partition wall respectively so as to urge the piston to move at a predetermined speed to the position for forming a pulse.

6. A hydraulic monitor according to claim 1, wherein the means for retarding the motion of the separating member comprises at least two cylindrical compression springs, the pulse-forming means comprises at least two limit stops for terminating the motion of the separating member at its end position for forming a pulse, located adjacent the corresponding barrel, and the separating member is made in the form of a piston, and each said compression spring being disposed between said piston and said limit stop.

7. A hydraulic monitor according to claim 6, wherein the piston has two cavities, each open on the side of each limit stop and a corresponding number of discs screwed into these cavities.

8. A hydraulic monitor according to claim 1, wherein the means for retarding the motion of the separating member is made in the form of a tube made from an elastic material, filled with a compressed gas, the pulse-forming means comprises at least two limit stops for terminating the motion of the separating member at its end position for forming a pulse, made in the form of a fairing, each located adjacent the corresponding barrel, the separating member is made in the form of a piston with two rods having a through duct for providing a hydraulic connection between the barrels, and a bearing end face for alternately providing a fluid-tight contact with the corresponding fairing when the piston is moving between the two end positions, and two partition walls arranged within said said enclosure member of the pulse-forming means on both side from the piston, each having a central opening through which a corresponding rod is extending in fluid-tight relationship, and forming together with the piston two chambers communicating through the opening in said enclosure with the corresponding barrel, each chamber accommodates the gas-filled elastic tube.

9. A hydraulic monitor according to claim 1, wherein the pulse-forming means comprises at least two enclosure members having their axis disposed parallel with the direction of delivering of the pulsating jet of liquid, hydraulically connected with each other through a corresponding delivery pipe-line with the valve means for distributing the flow of liquid, the separating member is composed of at least two ring pistons, each piston disposed within the corresponding enclosure member and connected with the corresponding barrel serving as a hollow rod, and the rod of each enclosure is hydraulically connected with the delivery pipe-line of the other one of at least two enclosure members of the pulse-forming means, the means for terminating the motion of the separating member at its end position for forming a pulse is composed of at least two compression springs, each said spring being mounted at the rod side of the corresponding enclosure member.

10. A hydraulic monitor according to claim 1, wherein the means for retarding the motion of the separating member is made in the form of a compression spring disposed between the separating member and the limit stop for terminating the motion of the separating member at its end position for forming a pulse, the separating member is a membrane, and on opposite sides from the membrane close to the corresponding barrel are disposed the limit stops made in the form of gratings.

11. A hydraulic monitor according to claim 1, wherein the means for retarding the motion of the separating member includes a portion of the enclosure member of the pulse-forming means, at least two restricting gratings disposed within said portion of the enclosure member and adjacent the corresponding barrel, the separating member is made in the form of at least two membranes, each located adjacent to and between the restricting gratings and forms together with said portion of said enclosure member a chamber filled with a compressed air urging the membranes against the corresponding restricting gratings, and the limit stops for terminating the motion of the separating member at its end position for forming a pulse are made in the form of gratings each arranged within said chamber and adjacent to each membrane so that each said membrane can travel between end positions defined at one side by the restricting grating and on the other side by said grating for terminating the motion of said membrane at its end position for forming a pulse.

12. A hydraulic monitor according to claim 1, wherein said means for retarding the motion of the separating member includes at least two chambers made in the form of sleeves closed by membranes, confined from inside and from outside by the gratings, and filled with a compressed gas so that the membranes are normally urged against the external grating, said chambers being coaxially mounted on the but-ends of said enclosure member of said pulse-forming means, said limit stops for terminating the motion of said separating member at its end position for forming a pulse comprises two partition walls, arranged in the central portion of said enclosure member in spaced relationship relative each other so that they together with said eclosure member form a central chamber, and in said enclosure member wall defining said central chamber there is provided an outlet opening, each said partition wall has a central opening, said separating member is composed of two pistons disposed externally of said partition wall defining said central chamber, and connected by a rod loosely extending with a gap through said openings in said partition walls, and the cavity of said enclosure member of said pulse-forming means close to the butt-ends of said enclosure member being hydraulically connected with said corresponding barrel through a corresponding by-pass duct.

13. A hydraulic monitor according to claim 12, wherein the cavity of said enclosure member of said pulse-forming means close to and externally of said partition walls is hydraulically connected with the corresponding barrel, and a further barrel is mounted on said enclosure member, communicating with said central chamber through said outlet opening.

* * * * *